US007004609B2

(12) United States Patent
Behr et al.

(10) Patent No.: US 7,004,609 B2
(45) Date of Patent: Feb. 28, 2006

(54) HEADLAMP BULB

(75) Inventors: Gerhard Behr, Altheim (DE); Peter Helbig, Sontheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 125 days.

(21) Appl. No.: 10/490,313

(22) PCT Filed: Aug. 13, 2002

(86) PCT No.: PCT/DE02/02967

§ 371 (c)(1),
(2), (4) Date: Mar. 19, 2004

(87) PCT Pub. No.: WO03/032365

PCT Pub. Date: Apr. 17, 2003

(65) Prior Publication Data

US 2004/0240228 A1 Dec. 2, 2004

(30) Foreign Application Priority Data

Sep. 28, 2001 (DE) ..... 101 48 115

(51) Int. Cl.
*H01R 13/625* (2006.01)

(52) U.S. Cl. ..... 362/549; 362/651

(58) Field of Classification Search ..... 362/457, 362/498, 507, 538, 540, 548, 651, 649; 439/57, 439/547, 332

See application file for complete search history.

(56) References Cited

U.S. PATENT DOCUMENTS

| | | | | |
|---|---|---|---|---|
| 4,682,274 | A * | 7/1987 | Freudenreich et al. | 362/519 |
| 5,361,191 | A * | 11/1994 | Matsuzaki et al. | 362/549 |
| 6,082,883 | A * | 7/2000 | Tatsumi et al. | 362/548 |
| 6,254,252 | B1 | 7/2001 | Coushaine et al. | 362/549 |
| 6,607,293 | B1 * | 8/2003 | Sanuki et al. | 362/430 |
| 6,710,526 | B1 * | 3/2004 | Helbig | 362/640 |
| 6,752,524 | B1 * | 6/2004 | Becker et al. | 362/548 |
| 2005/0002187 | A1 * | 1/2005 | Behr et al. | 362/226 |

FOREIGN PATENT DOCUMENTS

| | | |
|---|---|---|
| DE | 199 51 203 | 4/2001 |
| HU | 219 697 B | 9/1999 |

* cited by examiner

*Primary Examiner*—Alan Cariaso
*Assistant Examiner*—Adam C. Rehm
(74) *Attorney, Agent, or Firm*—William E. Meyer

(57) ABSTRACT

A headlight lamp has at least one lamp vessel in which at least one luminous element is enclosed, and a lamp base, which is provided with the electric terminals of the headlight lamp. The base has an annular metallic holder in which the at least one lamp vessel is fixed, and at least three reference noses arranged in a common plane, and an annular base flange arranged parallel to the plane of the reference noses. The base flange has at least three lugs are arranged along its circumference, which are of resilient design and serve together with the reference noses for fastening the lamp in a headlight. The reference noses are integrally formed on a reference ring, which is connected to the annular metallic holder and to the base flange.

4 Claims, 3 Drawing Sheets

HEADLAMP BULB

I. TECHNICAL FIELD

Figure 1:
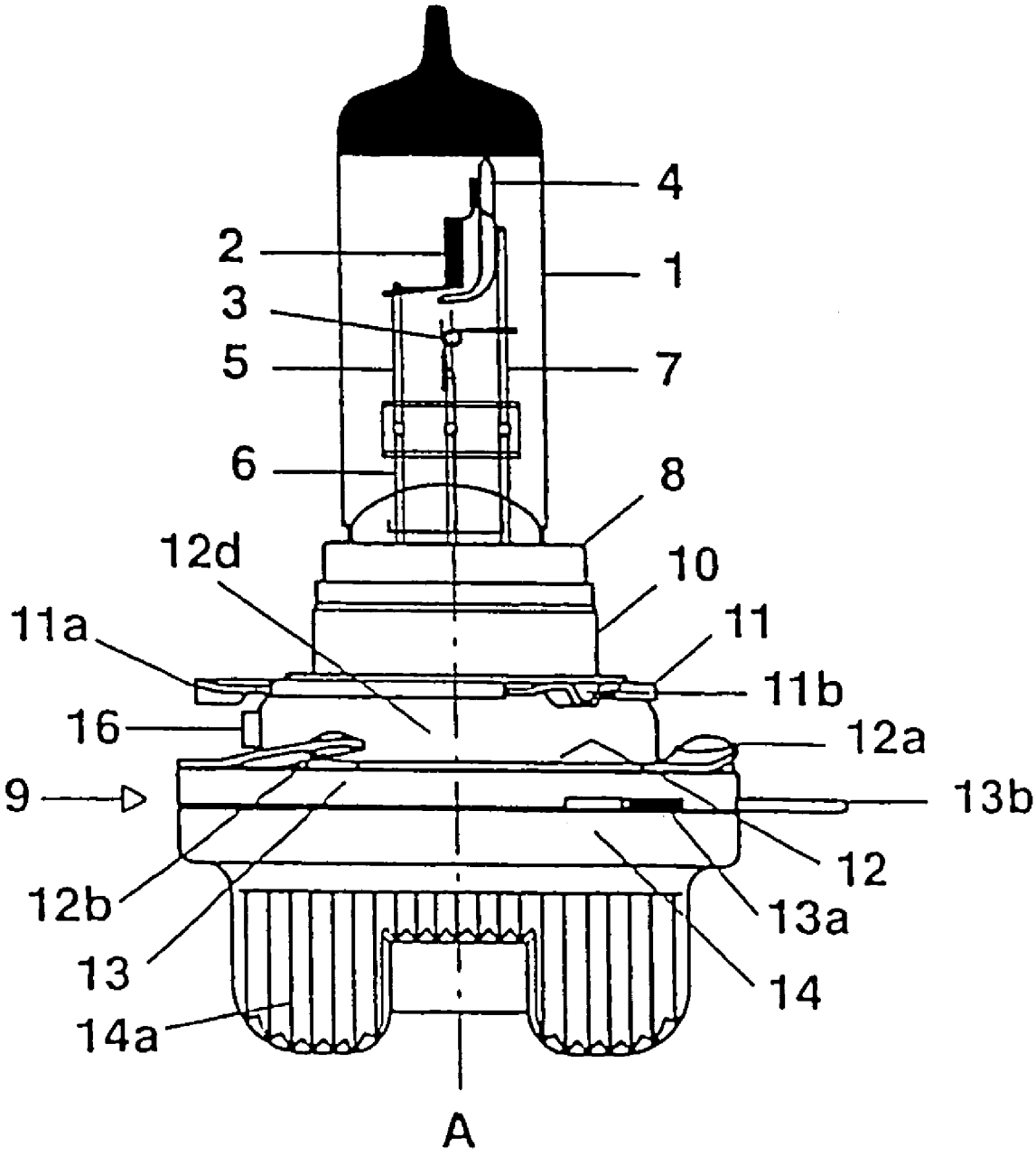

The invention relates to a headlight lamp comprising at least one lamp vessel with at least one luminous means enclosed therein, a lamp base which is provided with the electric terminals of the headlight lamp, and having an annular metallic holder in which the at least one lamp vessel is fixed.

II. BACKGROUND ART

Such a headlight lamp is disclosed, for example, in German Laid-open Patent Application DE 199 51 203 A1. This patent application describes a headlight lamp having a lamp vessel, an incandescent filament enclosed therein, and a lamp base which is provided with the electric terminals of the headlight lamp. The lamp base has an annular metallic holder for anchoring the lamp vessel. Moreover, the lamp base has three reference noses arranged in a common plane, and an annular base flange, the base flange plane being arranged parallel to the plane of the reference noses. The base flange is provided with three lugs of resilient design which are arranged along its circumference and serve together with the reference noses for fastening the lamp in a headlight. Owing to the adjustment of the incandescent filament with reference to the reference noses, when the base is being mounted undesired slots or openings can result in the lamp base, and so dust can penetrate into the lamp base.

III. DISCLOSURE OF THE INVENTION

It is the object of the invention to provide a headlight lamp in the case of which the abovenamed disadvantages are avoided.

This object is achieved according to the invention by means of the features of patent claim 1. Particularly advantageous designs of the invention are described in the dependent claims.

The headlight lamp according to the invention has at least one lamp vessel with at least one luminous means enclosed therein, and a lamp base which is provided with the electric terminals of the headlight lamp, the lamp base having an annular metallic holder, in which the at least one lamp vessel is fixed and at least three reference noses, arranged in a common plane, as well as an annular base flange whose base flange plane is arranged parallel to the plane of the reference noses, the base flange being provided with at least three lugs which are arranged along its circumference, are of resilient design and serve together with the reference noses for fastening the lamp in a headlight. According to the invention, the reference noses are integrally formed on a reference ring which is connected to the annular metallic holder and to the base flange and which has a flat annular surface arranged parallel to the base flange plane, the outside diameter of the annular surface being greater than or equal to the inside diameter of the base flange and greater than or equal to the outside diameter of the annular metallic holder, and the inside diameter of the annular surface being smaller than the inside diameter of the base flange and smaller than the outside diameter of the annular metallic holder.

The abovenamed measures and features ensure that no undesired slots or openings result between the base flange and the holder during mounting of the base. The inside and the outside diameters of the annular surface of the additional reference ring are coordinated with the corresponding diameter of the base flange and the holder such that even the adjustment of the luminous means with reference to the reference noses cannot form any slots or openings between the base flange and the holder. The annular surface of the reference ring can, furthermore, be used for welding the metallic base parts, in particular the holder and the base flange. As a result, the two surfaces of the reference noses remain free from welded joints, and so they can be used for mounting the lamp in the headlight. In particular, the headlight lamp according to the invention can be mounted in two different ways in the opening, designed as lamp holder, of a headlight reflector. Firstly, the lamp according to the invention can be inserted into the reflector such that the rim of the reflector opening is arranged with a clamping fit between the reference noses and the resiliently designed lugs of the base flange. In this case, the reference noses engage in the reflector and their surface facing the lamp vessel serves as reference plane for the alignment of the incandescent filament or the luminous means of the lamp inside the reflector. Owing to the locking of the bayonet lock, which is formed by the reference noses and the base flange lugs of the lamp, and by the reflector rim designed as lamp holder, the reference noses reach their predetermined position in the reflector, as a result of which the luminous means of the lamp is aligned with reference to the focal point and the optical axis of the reflector. Secondly, the lamp according to the invention can, however, also be inserted into the headlight in such a way that the surface, facing the lamp vessel, of the reference noses bears against the outer wall of the reflector rim. In this case, the lamp must be fixed with a clamping action on the rear wall of the reflector by means of a bracket, as is customary with H4 and H7 lamps. The type of mounting is a function of the properties of the headlight.

The annular metallic holder is advantageously provided with a rim which rests on the annular surface of the reference ring and is connected to it. The welding of the holder to the reference ring is thereby facilitated. The reference noses are advantageously designed to be cambered in the region of their edges running radially with reference to the reference ring. This prevents any sharp edges of the reference noses from causing wear on the reflector wall which could lead to dirt deposits in the headlight. Moreover, the reference ring and the base flange advantageously form an undercut, in order to prevent maladjustment of the lamp in the headlight by a possible burr on the reflector neck. For this purpose, an annular groove is advantageously arranged in the region of the contact surface of the reference ring and the base flange.

IV. BRIEF DESCRIPTION OF THE DRAWINGS

Figure 2:
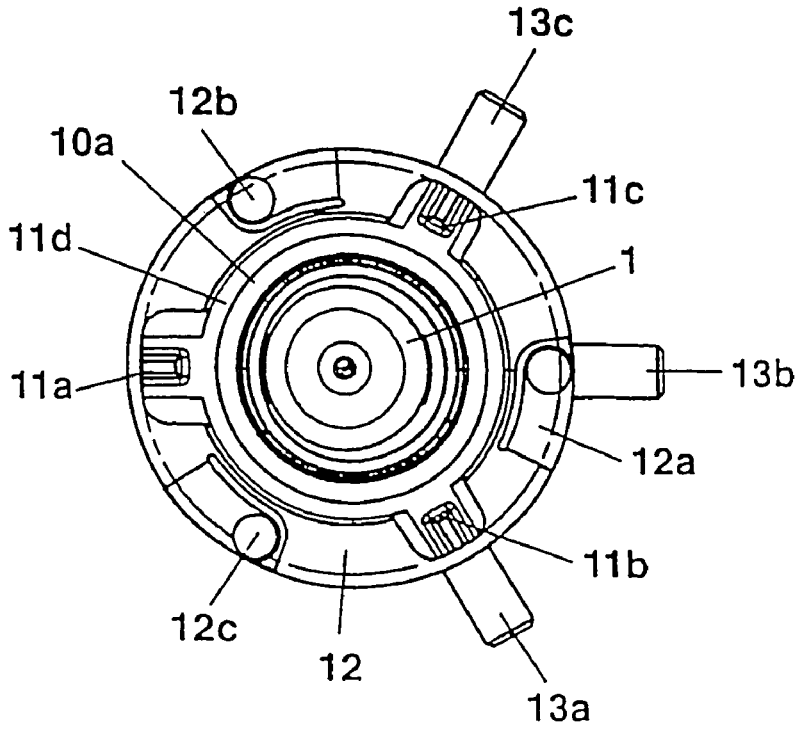
Figure 3:
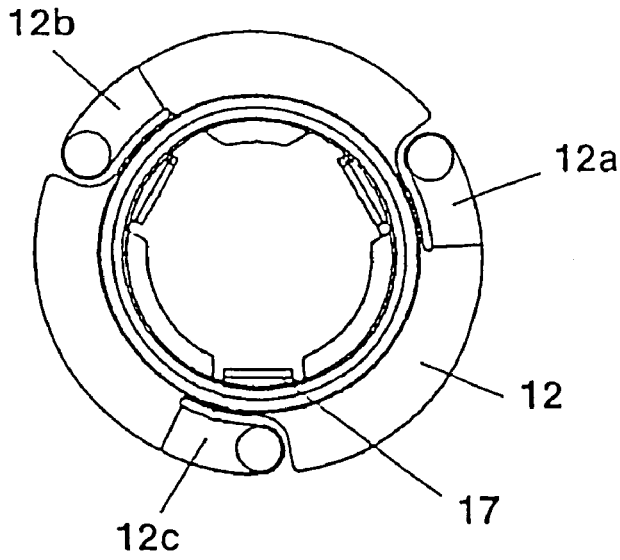
Figure 4:
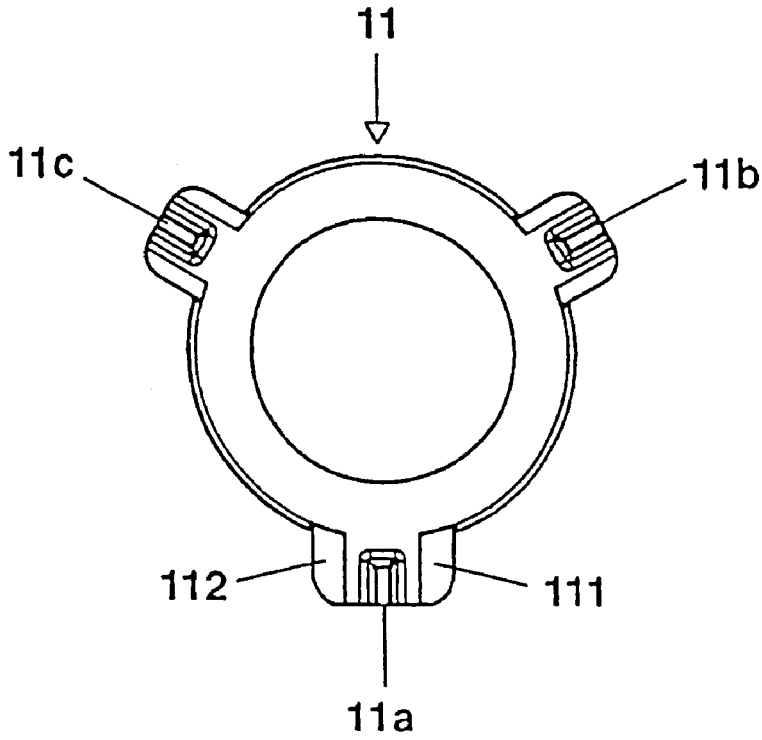
Figure 5:
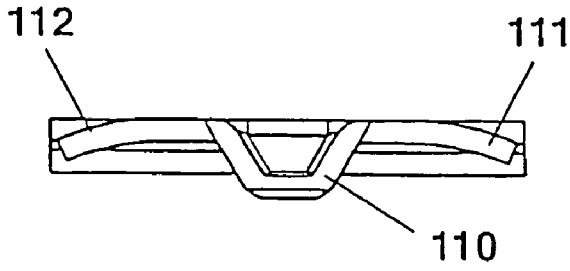

The invention is explained in more detail below with the aid of a preferred exemplary embodiment. In the drawing:

FIG. 1 shows a side view of the preferred exemplary embodiment of the headlight lamp according to the invention, FIG. 2 shows a plan view of the headlight lamp illustrated in FIG. 1, and FIG. 3 shows a plan view of the base flange of the lamp illustrated in FIG. 1, FIG. 4 shows a plan view of the reference ring of the lamp illustrated in FIG. 1, and FIG. 5 shows a side view of a reference nose of the reference ring illustrated in FIG. 4.

V. BEST MODE FOR CARRYING OUT THE INVENTION

The preferred exemplary embodiment, illustrated in FIG. 1, of the invention is a two-filament halogen incandescent lamp which is provided for insertion into a motor vehicle headlight. This lamp has a vitreous, essentially cylindrical lamp vessel 1, inside which there are enclosed two incandescent filaments 2, 3 of which one is arranged axially and the other in a transverse fashion to the longitudinal axis A of the lamp or the cylinder axis of the lamp vessel 1. The axially arranged incandescent filament 2 is surrounded in part by an anti-dazzle device 4, likewise arranged inside the lamp vessel 1. Three supply leads 5, 6 and 7, which are led out of the end of the lamp vessel 1 near the base, serve to hold and supply voltage to the incandescent filaments 2, 3 and the anti-dazzle device 4. The end of the lamp vessel 1 near the base is anchored with a clamping fit in a cutout in a metallic fixing ring 8 which is, for its part, a component of the lamp base 9. The metallic fixing ring 8 is fixed in the metallic adjusting ring 10. The adjusting ring 10 has a rim 10*a*, which is arranged perpendicular to the longitudinal axis A and is welded to the flat annular surface 11*d* of the metallic reference ring 11. The outside diameter of the adjusting ring 10 is 24 mm, and its inside diameter is 19.2 mm. The annular surface 11*d* of the reference ring 11 is arranged substantially perpendicular to the longitudinal axis A. The outside diameter of the reference ring 11 or its annular surface 11*d* is 28 mm, and its inside diameter is 19 mm. The reference ring 11 has three reference noses 11*a*, 11*b* or 11*c* which extend radially outward in a fashion substantially perpendicular to the longitudinal axis A and lie in a common plane. These reference noses 11*a*–11*c* are integrally formed on the flat annular surface 11*d* and arranged along the circumference of the reference ring 11 at a spacing of 120 degrees. The reference nose 11*a* is wider than the two other reference noses 11*b*, 11*c* in design, in order to define an orientation or installation position of the lamp in the headlight. By means of the conventional adjusting processes, during welding of the metal base parts 8, 10 and 11 the two incandescent filaments 2, 3 are aligned exactly with reference to the three reference noses 11*a*–11*c* and the reference plane defined by them, such that the orientation and installation position of the three reference noses 11*a*–11*c* inside the headlight reflector can also uniquely fix the arrangement of the incandescent filaments 2, 3 in the reflector during insertion of the lamp into a headlight. The reference ring 11 is welded to the annular collar 12*d* of the metallic, annular base flange 12, whose flange plane is arranged substantially perpendicular to the longitudinal axis A. The outside diameter of the base flange 12 is 39 mm, and its inside diameter is 28 mm. The base flange 12 has three resiliently designed lugs 12*a*, 12*b*, 12*c* which are arranged uniformly along its annular circumference and develop a spring action in the longitudinal direction A of the lamp. The reference noses 11*a*–11*c* serve as opposing bearings to the resilient lugs. The reference noses 11*a*–11*c* form a bayonet lock together with the base flange 12 and its lugs 12*a*–12*c*, as well as with the opening, correspondingly configured as lamp holder, of the headlight reflector. After the locking of the bayonet lock, the rim of the abovenamed opening of the headlight reflector is arranged with a clamping fit between the reference noses 11*a*–11*c* and the lugs 12*a*–12*c*. Serving to provide lateral fixing for the lamp at the rim of the headlight reflector is the press-on spring 16 which projects outward through a cutout in the annular collar 12*d* of the base flange 12.

Adjoining the metallic base flange 12 is the plastic ring 13, which is designed as an injection-molded part and from which project three metallic contact lugs 13*a*, 13*b*, 13*c*, which are connected in each case in an electrically conducting fashion to a supply lead 5, 6, 7 and form the electric contacts of the headlight lamp. The end, averted from the lamp vessel 1, of the lamp base 9 is formed by the grip part 14, which consists of plastic and is fixed by an undetachable plug-in connection on the plastic ring 13 and on the base flange 12. The grip part 14 has a web 14*a* running perpendicular to the longitudinal axis A along a diameter of the plastic ring 13. The web 14*a* can serve as a grip for locking and unlocking the bayonet lock when changing the lamp.

FIGS. 3 to 5 show details of the base flange 12 and the reference ring 11. The base flange 12 has three webs 17, provided with barbs, for producing the abovedescribed undetachable plug-in connection to the grip part 14. The reference noses 11*a*–11*c* each have an approximately V-shaped groove 110, which extends in the radial direction of the reference ring and serves for stopping the abovementioned bayonet lock between the lamp and the headlight behind webs, appropriately coordinated therewith, at the reflector rim. The reference noses are cambered in the region of their radially running edges 111, 112, such that these edges 111, 112 run outside the annular plane 11*d*. In the region of their contact surface—the collar 12*d* of the base flange 12 and the reference ring 11 together form an undercut such that a possible burr on the rim of the reflector opening does not lead to a maladjustment of the lamp in the headlight, since this burr would disappear in the undercut. Owing to the undercut, the edge, facing the reference ring 11, of the collar 12*d* of the base flange 12 is rounded and has a slightly smaller outside diameter than the remainder of the collar 12*d*. This results in the formation of an annular groove in the region of the contact surface of the reference ring 11 and the collar 12*d* (FIG. 1).

The invention claimed is:

1. A headlight lamp comprising:

at least one lamp vessel with at least one luminous means enclosed therein, a lamp base which is provided with electric terminals for electrically connecting the headlight lamp, the lamp base having an annular metallic holder in which the at least one lamp vessel is fixed, the lamp base having at least three reference noses arranged in a common plane, and having an annular base flange, the base flange plane being arranged parallel to the plane of the reference noses, and the base flange being provided with at least three lugs which are arranged along its circumference, are of resilient design and serve together with the reference noses for fastening the lamp in a headlight, wherein the reference noses are integrally formed on a reference ring which is connected to the annular metallic holder and to the base flange and which has a flat annular surface arranged parallel to the base flange plane, the outside diameter of the annular surface being greater than or equal to the inside diameter of the base flange and greater than or equal to the outside diameter of the annular metallic holder, and the inside diameter of the annular surface being smaller than the inside diameter of the base flange and smaller than the outside diameter of the annular metallic holder.

2. The headlight lamp as claimed in claim 1, wherein the annular metallic holder has an annular rim which rests on the annular surface of the reference ring and is connected to it.

3. The headlight lamp as claimed in claim 1, wherein the reference noses are cambered in the region of their edges running radially with reference to the reference ring.

4. The headlight lamp as claimed in claim 1, wherein the reference ring and the base flange form an undercut.

* * * * *